US006032636A

United States Patent [19]

Kajino

[11] Patent Number: 6,032,636

[45] Date of Patent: Mar. 7, 2000

[54] DISC-TYPE ROTARY ENGINE

[76] Inventor: Yukio Kajino, 3279-6, Ooaza, Yokoze, Yokoze-machi, Chichibu-gun, Saitama-ken, Japan

[21] Appl. No.: 09/149,356

[22] Filed: Sep. 8, 1998

Related U.S. Application Data

[62] Division of application No. 08/942,696, Sep. 29, 1997, Pat. No. 5,836,283.

[30] Foreign Application Priority Data

Nov. 19, 1996 [JP] Japan ..... 8-323413

[51] Int. Cl.[7] ..... F02B 53/00

[52] U.S. Cl. ..... 123/230; 418/68

[58] Field of Search ..... 123/221, 228, 123/230, 241; 418/68

[56] References Cited

FOREIGN PATENT DOCUMENTS

| | | |
|---|---|---|
| 2139926 | 4/1973 | Germany . |
| 4401285 | 9/1994 | Germany . |
| 58-206801 | 12/1983 | Japan . |
| 27071 | 2/1914 | United Kingdom . |
| 514628 | 11/1939 | United Kingdom . |
| 597743 | 2/1948 | United Kingdom . |

*Primary Examiner*—Michael Koczo
*Attorney, Agent, or Firm*—Armstrong, Westerman, Hattori, McLelend & Naughton

[57] ABSTRACT

A rotary disc having at least two radial concave portions and two radial convex portions on one end is opposed at the concave/convex surface to a concave/convex surface of a non-rotary disc having the concave/convex surface of the same shape, and one of the discs is made axially slidably and engaged to the other resiliently. Two variable volume chambers formed between the concave/convex surfaces of the two disc are used as a set of engine chambers in which a suction port is disposed to a slope of the first chamber on the side that the concave/convex surfaces of discs get into engagement, and the exhaust port is disposed to the slope of the second chamber on the side that the concave/convex surfaces of discs get out of the engagement. A gas reservoir combustion chamber communicating by way of a compression communication channel is disposed between the first chamber and the second chamber, and the compression stroke and the exhaust stroke are conducted simultaneously, while the expansion stroke and the suction stroke are conducted simultaneously in the two concave portions of the rotary disc passing through the two chambers.

4 Claims, 3 Drawing Sheets

DISC-TYPE ROTARY ENGINE

This application is a division of prior application Ser. No. 08/942,696 filed Sep. 29, 1997, U.S. Pat. No. 5,836,283.

BACKGROUND OF THE INVENTION

FIELD OF THE INVENTION

The present invention concerns a disc-type rotary engine for conducting suction, compression, expansion and exhaustion in a pair of variable volume chambers formed between opposed concave/convex surfaces of a rotary disc and a non-rotary disc.

Piston type internal combustion engines using a cylinder, a piston and a crank, in which a fuel sucked into the cylinder is compressed and put to explosive combustion and a reciprocal motion is converted into a rotary motion, have generally been used as driving means, for example, for automobiles.

In the piston-type internal combustion engine of this kind, it is considered ideal that the fuel is ignited just before the completion of the compression stroke of the piston, and the expansion stroke is completed before the piston reaches the lower dead point.

However, since the propagation speed of ignition to the fuel is slow and since the engine adopts a structure of reciprocating the piston between the upper dead point and the lower dead point at a predetermined stroke, the expansion stroke tends to continue even after the piston has past the lower dead point. This means that expansion exerts as far as the exhaust stroke in which the piston goes toward the upper dead point to cause great resistance. Therefore, the reduction ratio of the generated kinetic energy relative to the consumed fuel energy is increased to worsen the fuel efficiency.

Further, if the reduction ratio for the consumed energy such as of gasoline or light oil is increased, since this results in incomplete combustion or generation of denatured deleterious compounds, it leads to economical loss, as well as causes public pollution.

In recent gasoline engines, fuels are tend to be supplied excessively relative to the displacement volume to obtain a large power with an aim of increasing the ratio of power to the exhaust. However, since the existent piston type internal combustion engine tends to cause incomplete combustion due to delay of the ignition propagation as described above, this trend promotes the generation of incomplete combustion gases and a countermeasure therefor is additionally required.

Also in the field of engines using light oil, since fuels are burnt at a high compression ratio in piston-type engines using light oil in the prior art, generation of nitrogen oxides due to high temperature combustion increases the problem of public pollution.

OBJECT OF THE INVENTION

It is, accordingly, a principal object of the present invention to provide a novel engine capable of reducing public pollution caused by incomplete combustion and capable of restricting the reduction ratio for the power relative to the consumed fuels, by using two variable volume chambers defined by rotary discs.

Another object of the present invention is to provide an engine capable of suppressing the generation of nitrogen oxides and capable of obtaining a power at high efficiency even in a case of using light oil.

SUMMARY OF THE INVENTION

The foregoing object of the present invention can be attained in accordance with a disc-type rotary engine using a non-rotary disc and a rotary disc each having an undulatory concave/convex surface having at least two radial concave portions and two radial convex portions formed on one end, in which suction.compression strokes are conducted in one while expansion.exhaust strokes are conducted in the other of a pair of variable volume chambers formed between the non-rotary disc and the rotary disc by the rotation of the rotary disc.

In this rotary engine, two convex portions of the rotary disc are put to sliding contact in the pair of chambers simultaneously, whereby the compression stroke and the exhaust stroke proceed simultaneously and the expansion stroke and the fuel supply stroke proceed simultaneously.

DESCRIPTION OF THE PREFERRED EMBODIMENTS

The present invention will be explained by way of preferred embodiments with reference to the accompanying drawings.

Figure 1:
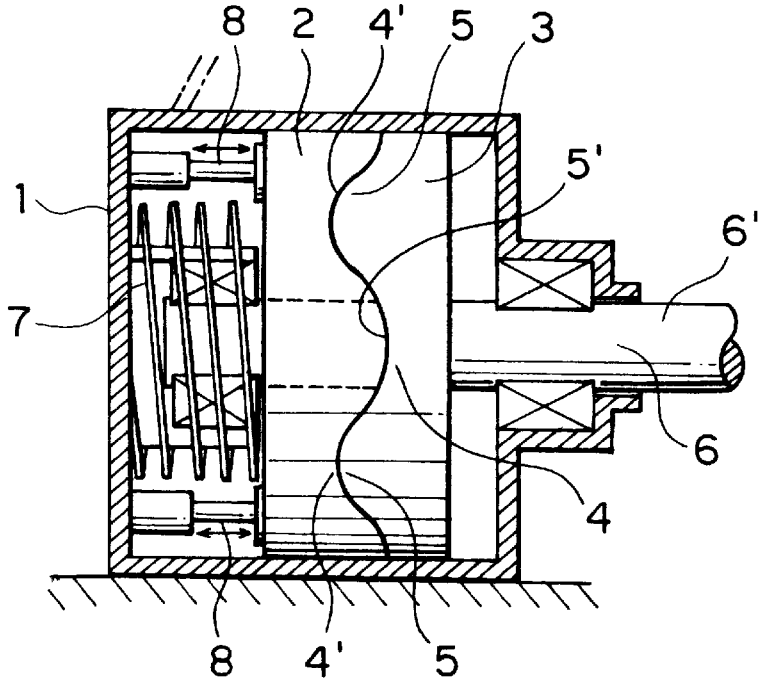
FIG. 1 is a schematic explanatory view for the inside of a disc-type rotary engine according to the present invention taken along a cross section of an engine casing.

As shown in FIG. 1, a disc-type rotary engine has an engine casing 1 having an inner circumferential wall of a completely circular cross sectional shape at the inside, and a non-rotary disc 2 and a rotary disc 3 each of a completely circular shape are fitted airtightly to the inside of the engine casing 1 with their axial ends being opposed to each other.

Figure 2:
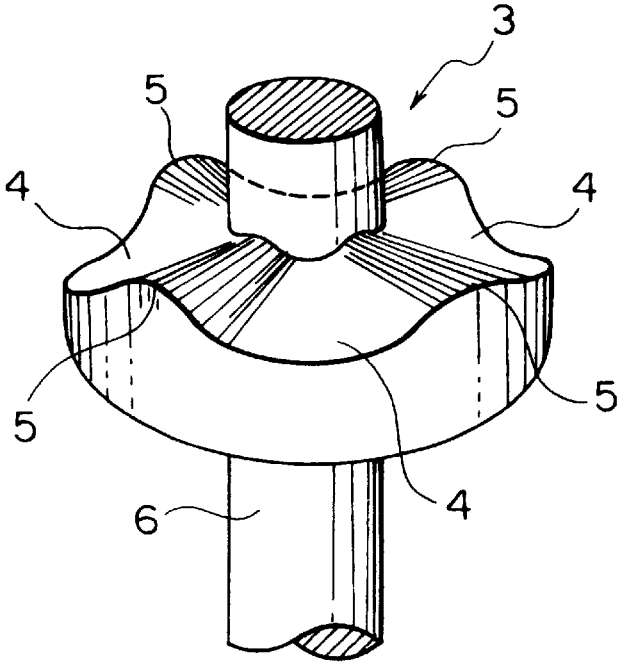
FIG. 2 is a perspective view of a rotary disc.

Each of the opposed surfaces of the non-rotary disc 2 and the rotary disc 3 has, as shown in FIG. 2, an undulatory concave/convex surface in which a plurality of radial concave portions 4 (four in the drawing) and a plurality of radial convex portions 5 (four in the drawing) are connected alternately, and the concave/convex surface is formed in a moderately curved stream line shape.

In the embodiment shown in FIG. 1, the rotary disc 3 has an integrally rotatable shaft 6 at the axial center and is rotatably fitted by pivoting the shaft 6 to the casing 1. One end of the shaft 6 protruding out of the casing 1 constitutes a rotary power shaft 6'.

As described above, the non-rotary disc 2 has, at the surface opposed to the rotary disc 3, an undulatory concave/convex surface of a stream line shape which is in an intimate engagement with the undulatory concave/convex surface of the rotary disc 3 and fitted not rotatably in the engine casing 1. For easy understanding, the concave portion of the non-rotary disc 2 is depicted by reference numeral 4', while the convex portion is depicted by reference numeral 5'.

The non-rotary disc 2 and the rotary disc 3 define at least a pair of variable volume chambers or gaps between the concave/convex surfaces of both of the discs 2 and 3 along with the rotation of the rotary disc 3. Accordingly, it is necessary that the non-rotary disc 2 and the rotary disc 3 are always in press contact with each other also during rotation, and that the convex portion of the rotary disc 3 can rotate overriding the convex portion of the non-rotary disc 2 against the force of the press contact. Therefore, in the present invention, it is adapted such that one or both of the non-rotary disc 2 and the rotary disc 3 can move slidably in the axial direction by a predetermined stroke, as well as the non-rotary disc 2 and/or rotary disc 3 thus made slidable can return by a resilient force.

For this purpose, in the embodiment shown in FIG. 1, only the non-rotary disc 2 is fitted axially slidably but not rotatably to the casing 1 by a spline engagement, and a resilient means such as a spring 7 and/or hydraulic cylinder 8 is disposed at the back of the non-rotary disc 2.

Figure 3:
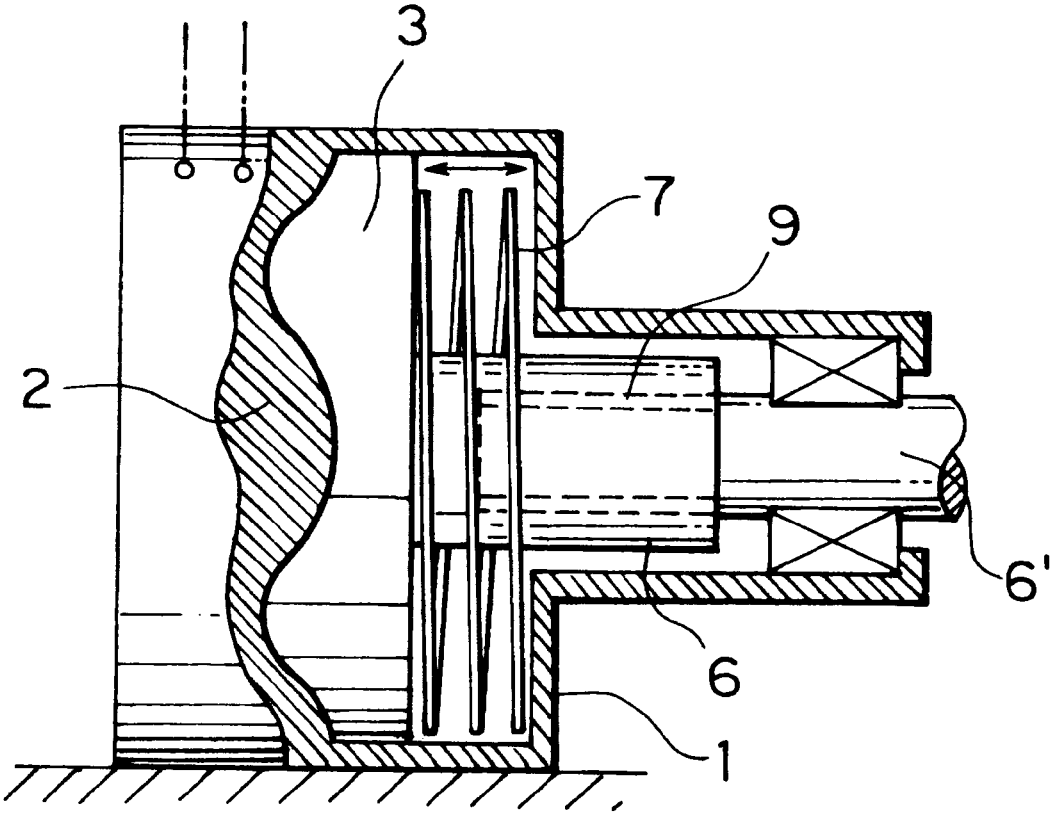
FIG. 3 is a view, corresponding to FIG. 1, for another embodiment according to the present invention.

On the contrary, in an embodiment shown in FIG. 3, the rotary disc 3 or a shaft 6 thereof is connected to a rotary power shaft 6' slidably and integrally rotatably by way of a spline engagement 9 and a resilient means such as a spring 7 and/or hydraulic cylinder (not illustrated) is disposed at the back of the rotary disc 3, by which the non-rotary disc 2 and the rotary disc 3 are always in press contact with each other. When the non-rotary disc 2 is not made slidable, the non-rotary disc 2 may be fixed to the engine casing 1, or it may be formed integrally with the engine casing 1.

In a case of slidably moving only one of the non-rotary disc 2 or the rotary disc 3 as described above, the sliding stroke is desirably defined to a size for the difference of a height between the concave portion and the convex portion at the undulatory concave/convex surface.

Although not shown in the drawing, the constitutions shown in FIG. 1 and FIG. 3 may be combined such that both of the non-rotary disc 2 and the rotary disc 3 are fitted axially slidably and resilient means may be disposed at the back of each of them. In this case, the sum of the sliding strokes for the non-rotary disc 2 and the rotary disc 3 is aligned with the size for the difference of the height on the concave/convex surface.

In the constitution described above, when the rotary disc 3 is rotated relative to the non-rotary disc 2, a plurality of chambers (gaps) that vary the volume in accordance with the displacement of the relative position between both of the concave/convex surfaces are formed between both of the concave/convex surfaces of the non-rotary disc 2 and the rotary disc 3.

In the present invention, a pair of adjacent chambers 10 and 11 are defined as a set of engine stroke chambers, in which a first chamber (a first concave portion) 10 at the rearward portion is used as a chamber for the suction stroke and the compression stroke, while the second chamber (second concave portion) 11 at the forward portion is used as a chamber for the expansion stroke and the exhaustion stroke, as viewed in the advancing direction of the rotary disc 3.

For this purpose, in the illustrated embodiment, a fuel supply channel 12 (suction port) from the outside is opened to a slope 10*a* along the first chamber 10 of the non-rotary disc 2 on the engaging side that the rotary disc 3 gets into sliding engagement with the non-rotary disc 2 as viewed from the rotating direction of the rotary disc 3. Further, an exhaust port 13 to the outside is opened to the slope 11*b* along the second chamber 11 of the rotary disc 3 at the next stage on the counter-engaging side that the rotary disc 3 gets out of sliding engagement with the non-rotary disc 2.

On the other hand, a gas reservoir combustion chamber 15 having an ignition plug 14 is disposed to the inside of the slope 11*a* in the second chamber 11 of the non-rotary disc 3 on the engaging side that the rotating disc 3 gets into sliding engagement with the non-rotary disc 2. The gas reservoir combustion chamber 15 is opened to the slope 11*a* on the engaging side, a compression communication channel 16 is formed from the slope 10*b* of the first chamber 10 on the counter-engaging side to the gas reservoir combustion chamber 15, and a check valve 17 opening only to the gas reservoir combustion chamber 15 is disposed to the communication channel 16.

The slope 11*a* of the chamber 11 on the engaging side may have an identical gradient with that of the slope 11*b* of the chamber 12 on the counter-engaging side but, desirably, the slope 11*a* on the engaging side is formed relatively shorter with an abrupt gradient while the slope 11*b* on the counter-engaging side is formed relatively longer with a moderate gradient. With such a constitution, the exit of the gas reservoir combustion chamber 15 is rapidly closed to improve the compression efficiency in the compression stroke and the resistance is reduced in the expansion stroke to attain a longer expansion stroke.

As described above, the first chamber 10 to which the fuel supply channel 12 and the compression communication channel 16 are opened and the second chamber 11 to which the gas reservoir combustion chamber 15 and the exhaustion port 13 are opened are disposed continuously as a pair at the concave/convex surface of the non-rotary disc 2.

In the illustrated embodiment, two sets of engine stroke chambers each comprising a first chamber and a second chamber are exemplified but they may be disposed by three or more sets between the concave/convex surfaces of the non-rotary disc 2 and the rotary disc 3.

In this illustrated embodiment, the fuel supply channel 12, the compression communication channel 16, the gas reservoir combustion chamber 15 and the exhaust port 13 are formed in the non-rotary disc 2. Alternatively, all or a portion of the fuel supply channel 12, the compression communication channel 16, the gas reservoir combustion chamber 15 and the exhaust port 13 may be penetrated in the engine casing 1 and they may be opened in the vicinity of the slopes 10*a*, 10*b*, 12*a*, 12*b*, respectively.

Then, the operation of the present invention will be explained with reference to FIG. 4*a* through FIG. 4*d*.

In FIG. 1 and FIG. 3, when a rotational force exerts on the rotary disc 3 in the direction of an arrow, the non-rotary disc 2 or the rotary disc 3 urged by the resilient means moves slidably in the axial direction, and the rotary disc 3 rotates while in sliding contact at the convex portion 5 thereof with the concave/convex surface of the non-rotary disc 2. As a result, variable volume chambers (gaps) are formed variously between opposed concave/convex surfaces of the non-rotary disc 2 and the rotary disc 3 as shown in FIG. 4*a* to FIG. 4*d* depending on the rotational position of the rotary disc 3.

Figure 4A:
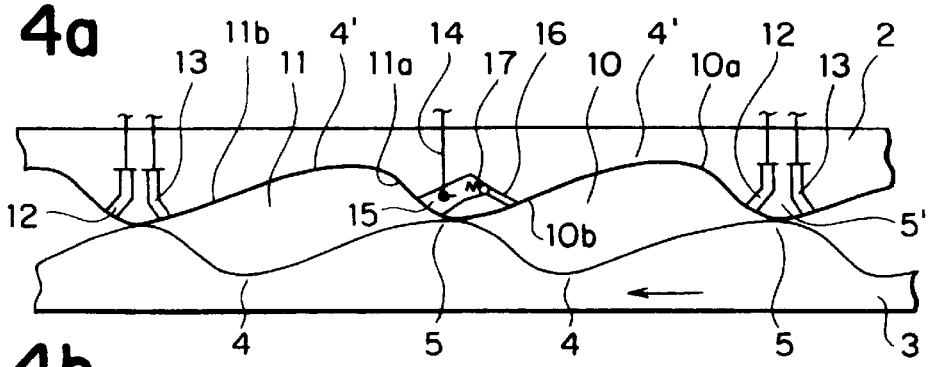
FIG. 4*a* is an explanatory view for a suction stroke in a rotary engine according to the present invention.

FIG. 4*a* shows a state in which the convex portion 5' of the non-rotary disc 2 is in a sliding contact with the convex portion 5 of the rotary disc 3 and the volume of the first chamber 10 and the second chamber 11 between both of the disc 2 and the disc 3 reaches the maximum. In this state, the expansion stroke in the second chamber 11 is completed, and the fuel supply in the first chamber 10 is also completed.

When the rotary disc 3 rotates from this state in the direction of the arrow, the first chamber 10 is compressed and the fuel is sent under pressure through the compression communication channel 16 to the gas reservoir combustion chamber 15. At the same time, the gas reservoir combustion chamber 15 is closed by the preceding convex portion 5 of the rotary disc 3 and the engine goes to the compression stroke. In this state, the gas in the second chamber 11 is exhausted by the preceding convex portion 5 of the rotary disc 3 from the exhaust port 13 and the engine goes to the exhaust step.

Figure 4B:
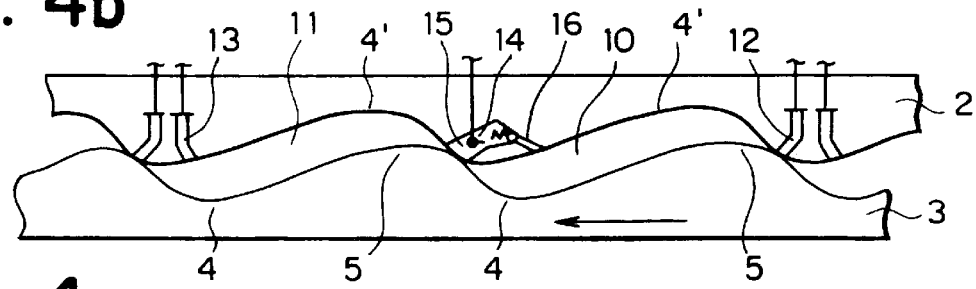
FIG. 4*b* is an explanatory view for compression exhaust strokes in the rotary engine according to the present invention.
Figure 4C:
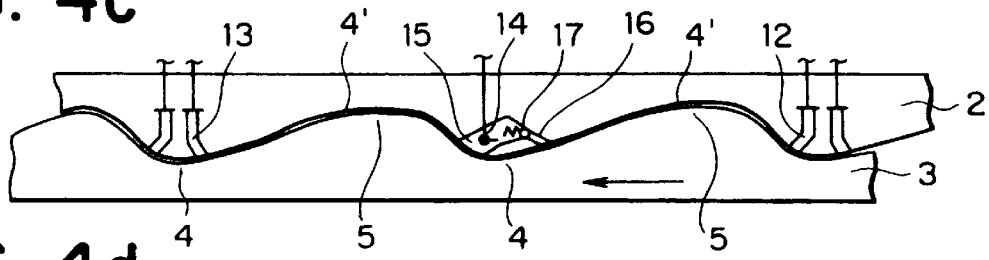
FIG. 4*c* is an explanatory view for showing the state upon completion of compression exhaustion strokes in the rotary engine according to the present invention.
Figure 4D:
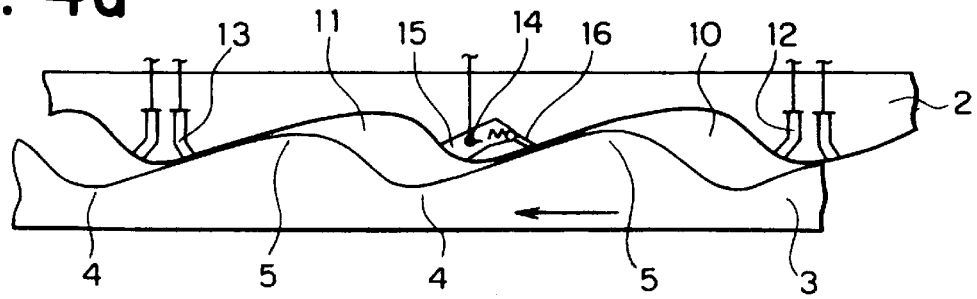
FIG. 4*d* is an explanatory view for expansion suction strokes in the rotary engine according to the present invention.

Accordingly, the compression stroke and the exhaustion stroke proceed simultaneously in the separate first chamber 10 and second chamber 11 in the state from FIG. 4*a* to FIG. 4*c*.

Then, when the ignition plug 14 in the gas reservoir 15 conducts ignition in the completed state of the compression stroke shown in FIG. 4*c,* the fuel expands explosively, and the rotary disc 3 is rotated in the direction of the arrow by the expansion force and, at the same time, the first chamber 10 goes to the suction stroke for the next stage. Accordingly, in the state from FIG. 4*c* to FIG. 4*a,* the expansion stroke and the suction stroke are conducted simultaneously in the separate second chamber 11 and first chamber 10.

Since expansion and suction proceed simultaneously and compression and exhaust proceed simultaneously as described above, the rotary disc 3 rotates continuously and rotational force is obtained from the rotary power shaft.

As described above in accordance with the present invention, since a pair of two chambers, the volume of which is variable in accordance with the relative positional change between opposed concave/convex surfaces, are used as a set of engine chambers, and compression and exhaust are conducted simultaneously while expansion and suction are conducted simultaneously, the following various advantages can be obtained.

Since the exhaust stroke is conducted after the expansion stroke is thoroughly completed, the expansion stroke and the exhaust stroke do not interfere with each other as in the prior art. Accordingly, since complete combustion of fuels can be promoted and all the expansion energy caused by explosion can contribute to the rotating force, the efficiency of the power energy relative to the fuel energy is increased remarkably. Further, since the undesired phenomenon that the fuel is exhausted before complete combustion can be avoided, occurrence of public pollution caused by incomplete combustion can be reduced.

Further, since the volume of each chamber in the engine chamber is relatively small, ignition rapidly propagates throughout the entire fuel supplied and complete combustion and high power can be obtained also in this regard.

Further, since compression and exhaust proceed simultaneously and expansion and suction proceed simultaneously in the two chambers, four strokes of suction, compression, expansion and exhaust are completed in two cycles. Accordingly, the contact resistance due to sliding movement is reduced to obtain rotary power at high efficiency.

Further, the compression ratio can be kept low because the volume in each of the chambers of the engine chamber is small. Accordingly, since the combustion temperature can be kept to a relatively low temperature in the case of using as an engine of using light oil, generation of nitrogen oxides can be suppressed.

What is claimed is:

1. A disc-type rotary engine comprising;

an engine having a cylindrical inner circumferential wall;

a non-rotary disk in which an undulatory concave/convex surface in a stream line shape having at least two radial concave portions and two radial convex portions alternately is formed on one end and which is fitted to the inner circumferential wall of the casing coaxially and air-tightly a rotary disk in which a radial concave/convex surface of the same shape as that of the undulatory concave/convex surface of the non-rotary disc is formed on one end, and which is fitted to the inner circumferential wall of the casing air-tightly and rotatably such that the convex portions of the concave/convex surface are in a sliding contact with the undulatory concave/convex surface of the non-rotary disc;

a rotary power shaft which rotates interlocking with the rotary disc and which is protruded at one end to the outside of the casing;

a resilient means for resiliently engaging the non-rotary disc or the rotary disc which is made slidable reciprocally in the axial direction along with the rotation of the rotary disc to the concave/convex surface of the mating rotary disc or the non-rotary disc;

a fuel supply channel in communication with a vicinity of a slope of a first concave portion formed on the non-rotary disc at which a convex portion of the rotary disc gets into sliding engagement with said concave portion;

an exhaust port in communication with a vicinity of a slope of a second concave portion formed on the non-rotary disc at which the convex portion of the rotary disc gets out of sliding engagement with said concave portion, a gas reservoir combustion chamber opened to a vicinity of a slope of a second concave portion formed on the rotary disc at which the convex portion of the rotary disc gets into sliding engagement with said concave portion, with an ignition plug being disposed at the inside of said reservoir; and a compression communication channel for communicating from a vicinity of a slope of the first concave portion formed on the non-rotary disc at which the convex portion of the rotary disc gets into sliding engagement with said concave portion to the gas reservoir fuel chamber by way of a check valve, wherein all or a portion of the fuel supply channel, the compression communication channel, the gas reservoir combustion chamber and exhaust port is disposed in the engine casing.

2. A disc-type rotary engine as defined in claim 1, wherein either one of the non-rotary disc or the rotary disc is disposed reciprocally and slidably in the axial direction at a stroke corresponding to the difference of height on the concave/convex surface.

3. A disc-type rotary engine as defined in claim 1, wherein both of the non-rotary disc and the rotary disc are disposed reciprocally and slidably in the axial direction and the sum of the sliding strokes for both of the rotary discs is adjusted to be equal with the difference of height on the concave/convex surface.

4. A disc-type rotary cylinder as defined in claim 1, wherein the resilient means comprises a spring, a compression cylinder or a combination thereof.

* * * * *